US006239755B1

(12) United States Patent
Klemens et al.

(10) Patent No.: US 6,239,755 B1
(45) Date of Patent: May 29, 2001

(54) BALANCED, RETRACTABLE MOBILE PHONE ANTENNA

(75) Inventors: Guy Klemens, San Diego; Ernest T. Ozaki, Poway; Allen Minh-Triet Tran, San Diego, all of CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 09/429,768

(22) Filed: Oct. 28, 1999

(51) Int. Cl.[7] ..... H01Q 1/24
(52) U.S. Cl. ..... 343/702; 343/895; 343/793
(58) Field of Search ..... 343/702, 895, 343/820, 821, 725, 727, 729, 730, 793, 829; 455/90; H01Q 1/24

(56) References Cited

U.S. PATENT DOCUMENTS 5,446,469 * 8/1995 Makino ..... 343/702
5,479,178 * 12/1995 Ha ..... 343/702
5,635,943 * 6/1997 Grunwell ..... 343/702
5,703,602 * 12/1997 Casebolt ..... 343/702
5,969,684 * 10/1999 Oh et al. ..... 343/702
6,034,650 * 3/2000 Kuramoto ..... 343/895

* cited by examiner

*Primary Examiner*—Hoanganh Le
*Assistant Examiner*—Trinh Vo Dinh
(74) *Attorney, Agent, or Firm*—Phillip R. Wadsworth; Charles D. Brown; Raymond B. Hom

(57) ABSTRACT

The balanced, retractable dipole antenna comprises a first radiator element that is selectively extendable from, and retractable into, a mobile phone casing, a second radiator element, and a counterpoise that is electrically isolated from a printed wire board (PWB) of a mobile phone. The balanced, retractable dipole antenna further comprises a signal balancing means coupled between a signal source and at least the second radiator element and counterpoise to generate first and second signals, respectively. The first and second signals are substantially equal in magnitude but out of phase by 180 degrees. When the first radiator is extended, the first signal is transferred to the first and second radiator elements, and the second signal is transferred to the counterpoise. When the first radiator element is retracted, the first signal is transferred to the second radiator, while the second signal is transferred to the counterpoise and the first radiator element. The first and second signals produce balanced currents, thereby producing a symmetric radiation pattern.

26 Claims, 14 Drawing Sheets

BALANCED, RETRACTABLE MOBILE PHONE ANTENNA

CROSS-REFERENCE TO RELATED APPLICATIONS

The following application of common assignee contains some common disclosure with that of the present invention: Balanced Dipole Antenna for Mobile Phones, Ser. No. 09/206,538 filed Dec. 7, 1998. This application is incorporated herein by reference in its entirety.

BACKGROUND OF THE INVENTION

I. Field of the Invention

The present invention relates generally to antennas. More specifically, the present invention relates to a balanced, retractable dipole antenna for mobile phones.

II. Description of the Related Art

Recent advancements in electronics have significantly improved the performance of mobile phones. For example, advancements in integrated circuit technology have led to high performance radio frequency (RF) circuits. The RF circuits are used to construct transmitters, receivers and other signal processing components typically found in mobile phones. Also, advancements in integrated circuit technology have led to a reduction in the size of RF circuits, thereby leading to a reduction in the overall size of a mobile phone.

Similarly, advancements in battery technology have resulted in smaller, lighter and longer lasting batteries used in mobile phones. These advancements have resulted in smaller and lighter mobile phones that operate for a longer period of time on a single charge.

Generally, a user of a mobile phone must be able to communicate with another user or a ground station that can be located in any direction from the user. For this reason, the antenna in the user's mobile phone must be able to receive and transmit signals from and in all directions. Consequently, it is desirable that the antenna exhibit a symmetric radiation pattern having a uniform gain in the azimuth. In addition, it is desirable for mobile phones to have antennas that are retractable.

Unfortunately, antennas found in today's typical mobile phones do not exhibit a symmetric radiation pattern. Mobile phones generally utilize monopole antennas (for example, a whip antenna) that, due to the presence of unbalanced currents, exhibit asymmetric radiation patterns. This is primarily due to the fact that the shape and dimension of a monopole are not equivalent to to the shape and dimension of a ground plane of a printed wire board (PWB) used as a counterpoise, resulting in an unequal current distribution in the monopole and in the ground plane.

As a result, it has been recognized that there is a need for an antenna for a mobile phone that exhibits a symmetric radiation pattern.

SUMMARY OF THE INVENTION

The present invention is directed to a balanced, retractable dipole antenna for mobile phones, such as cellular and PCS phones. The balanced, retractable dipole antenna comprises a first radiator element that is selectively extendable from, and retractable into, a mobile phone casing, a second radiator element, and a counterpoise that is electrically isolated from a printed wire board (PWB) of a mobile phone. The balanced, retractable dipole antenna further comprises a signal balancing means coupled between a signal source and at least the second radiator element and counterpoise to generate first and second signals, respectively. The first and second signals are substantially equal in magnitude but out of phase by 180 degrees. When the first radiator is extended, the first signal is transferred to the first and second radiator elements, and the second signal is transferred to the counterpoise. When the first radiator element is retracted, the first signal is transferred to the second radiator, while the second signal is transferred to the counterpoise and the first radiator element. The first and second signals produce balanced currents, thereby producing a symmetric radiation pattern.

Further features and advantages of the invention, as well as the structure and operation of various embodiments of the invention, are described in detail below with reference to the accompanying drawings.

BRIEF DESCRIPTION OF THE DRAWINGS

In the drawings, like reference numbers generally indicate identical, functionally similar, and/or structurally similar elements. The drawing in which an element first appears is indicated by the leftmost digit(s) in the reference number.

The present invention will be described with reference to the accompanying drawings, wherein.

DETAILED DESCRIPTION OF THE PREFERRED EMBODIMENTS

I. Overview of the Present Invention

As noted before, antennas found in today's typical mobile phones do not exhibit a symmetric radiation pattern. Mobile phones generally utilize monopole antennas that, due to the presence of unbalanced currents, exhibit asymmetric radiation patterns. This is illustrated further in FIGS. 1 and 2.

Figure 1:
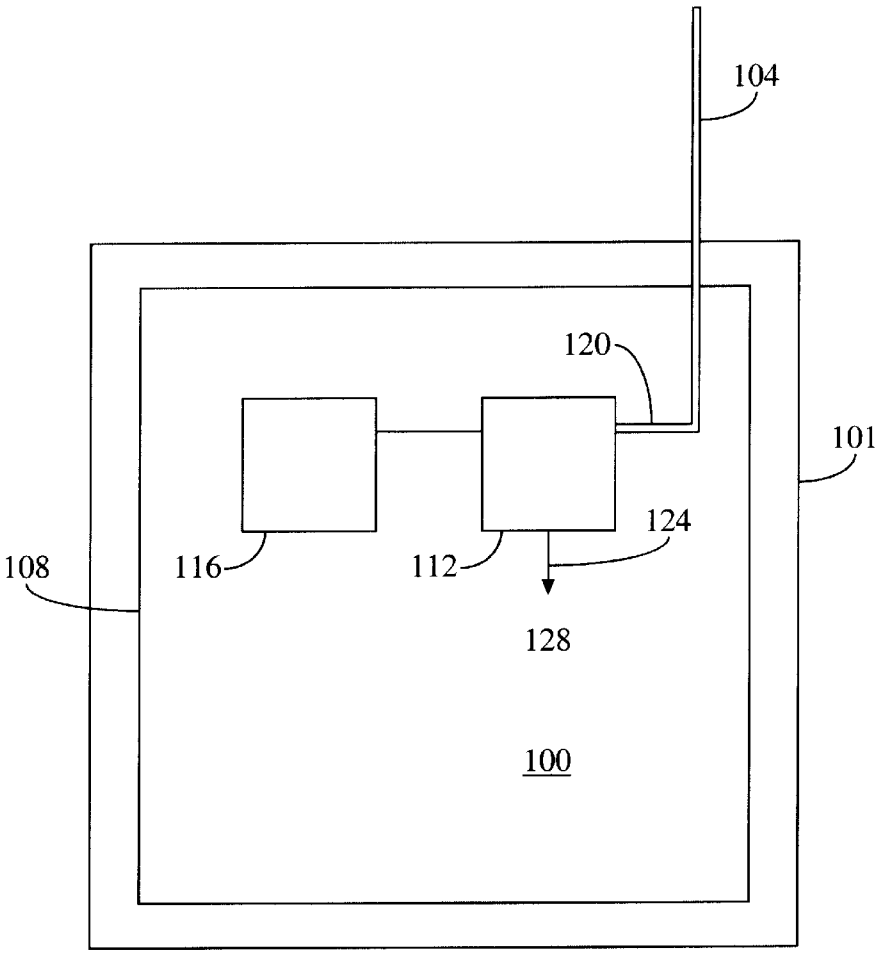
FIG. 1 (PRIOR ART)
FIG. 1 illustrates a monopole antenna used in a typical mobile phone.

FIG. 1 illustrates a monopole antenna 100 used in a typical mobile phone 101. The phone 101 contains transmit/receive circuits and other ancillary electronic and mechanical components needed to send and receive calls and to perform all other normal phone operations. These components are well known and are not shown or described further as they form no part of the present invention. Monopole antenna 100 comprises a radiator (a monopole) 104, a printed wire board (PWB) 108, a reactive matching network 112 and a signal source 116. Reactive matching network 112 comprises first and second outputs 120 and 124. First output 120 is connected to monopole 104 and second output 124 is connected to ground plane 128 of PWB 108. Ground plane 128 acts as a counterpoise in order to provide a return path for currents in monopole radiator 104.

Reactive matching network 112 forms an unbalanced feed to monopole 104. The unbalanced feed causes unbalanced currents to flow along ground plane 128. This is primarily due to the fact that the shape and dimension of monopole 104 are not equivalent to the shape and dimension of ground plane 128, resulting in unequal current distribution in monopole 104 and in ground plane 128. As a result, monopole 104 and ground plane 128 form an asymmetric dipole, thereby causing an asymmetric radiation pattern (that is, a distorted radiation pattern).

Figure 2:
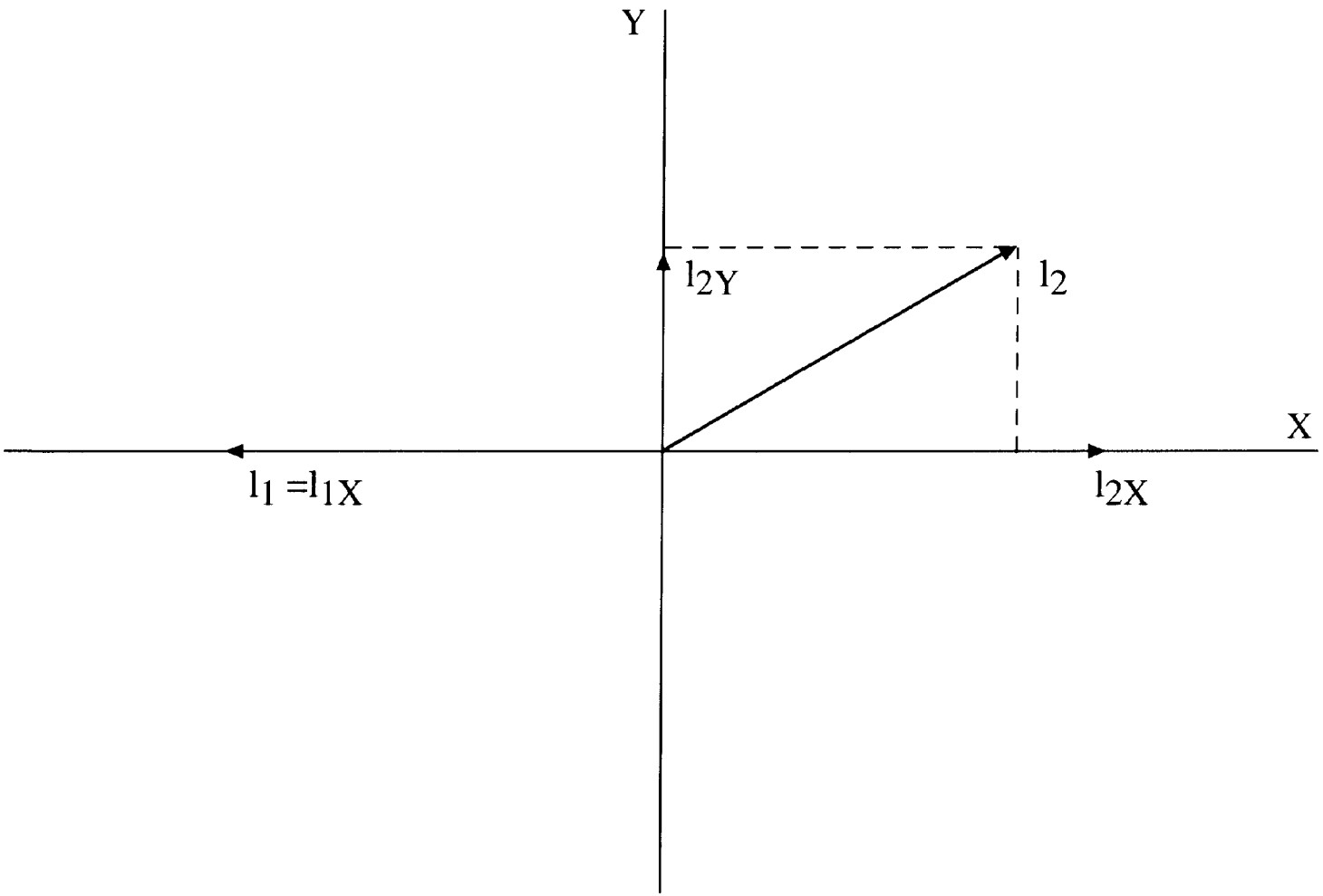
FIG. 2 (PRIOR ART)
FIG. 2 shows current vectors in a monopole antenna.

FIG. 2 shows the current vectors $I_1$ and $I_2$ in monopole 104 and ground plane 128, respectively. The horizontal component $I_{2x}$ of the current $I_2$ in ground plane 128 is balanced by the horizontal component $I_{1x}$ of the current $I_1$ in monopole 104. However, the vertical component $I_{2y}$ of the current $I_2$ in ground plane 128 remains unbalanced, because of a lack of an opposing vertical component in monopole 104. The shape and dimension of monopole 104 prevent the formation of a vertical component of the current vector $I_1$. As a result, unbalanced currents flow along ground plane 128, causing a distorted radiation pattern.

Furthermore, monopole antenna 100 provides less flexibility as its radiation pattern is driven by the size and/or shape of PWB 108. Since the size and/or shape of PWB 108 are driven in large part by the size and/or shape of the mobile phone's case that houses PWB 108, designers are often handicapped in their selection of a radiation pattern by the pre-existing size and/or shape of a mobile phone's case.

The present invention provides a solution to the aforementioned problems. The present invention is a balanced, retractable dipole antenna for a mobile phone, for example, a PCS phone or a cellular phone. The present invention advantageously incorporates a balanced dipole antenna in a mobile phone that significantly improves the radiation pattern of a mobile phone. In addition, the present invention provides an antenna that is retractable. Furthermore, the present invention allows designers to select desired radiation patterns for mobile phones without being constrained by the shape of PWBs. The balanced, retractable dipole antenna allows superior performance over conventional antennas found in mobile phones today by enabling a user of a mobile phone to communicate uniformly in all directions, that is, 360 degrees.

Figure 3:
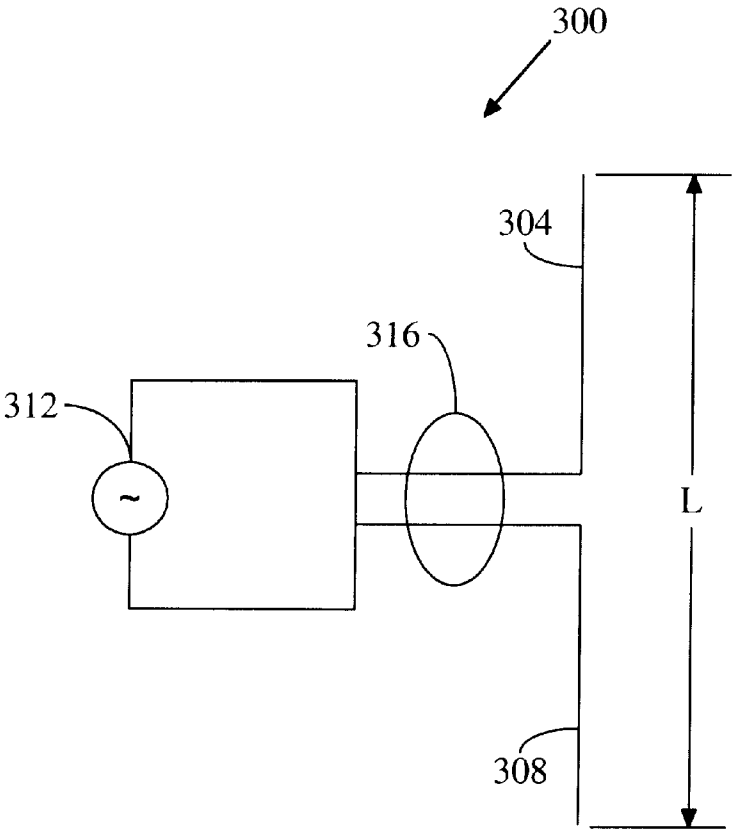
FIG. 3 illustrates a dipole antenna.

As noted above, the present invention incorporates the advantages of a dipole antenna in a mobile phone. Simply stated, a dipole antenna is a diverging two-wire transmission line. FIG. 3 illustrates a dipole antenna 300. Dipole antenna 300 comprises first and second radiators 304 and 308, respectively, connected to a signal source 312 by a two-wire transmission line 316.

Figure 4:
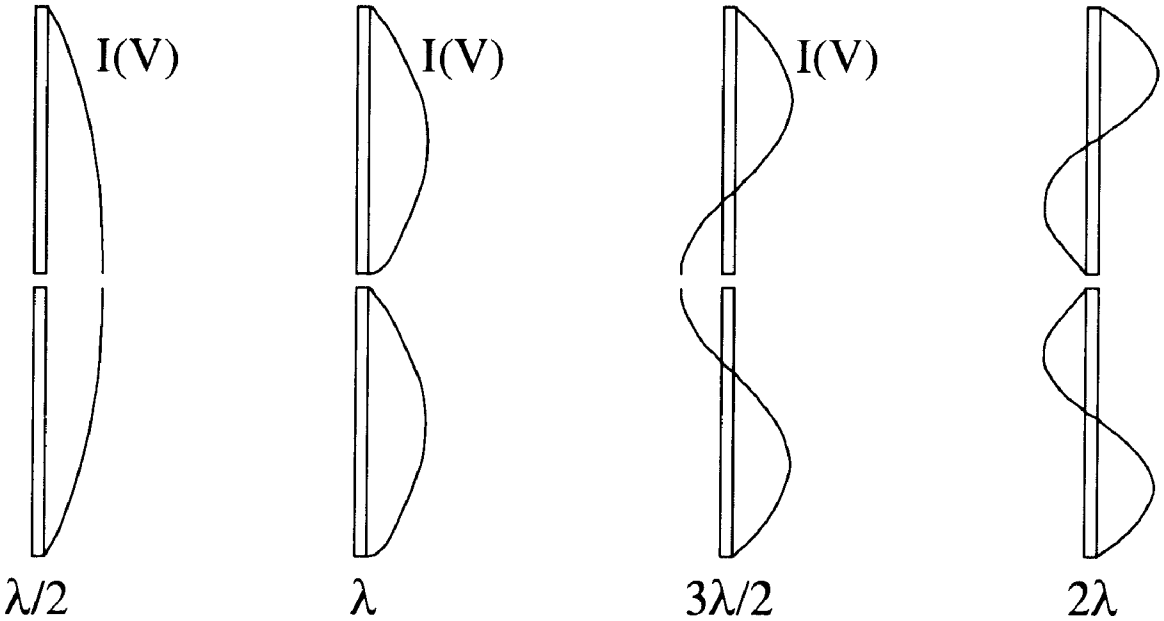
FIG. 4 shows current distributions in dipole antennas of different lengths.

Dipole antenna 300 can be of any length L, such as $L=\lambda$, $\lambda/2$, $\lambda/4$, where $\lambda$ corresponds to the wavelength of the operating frequency $f$ of dipole antenna 300. The current distributions in first and second radiators 304 and 308 are sinusoidal provided that the diameter of each radiator is less than $\lambda/100$. Examples of the approximate current distributions in a number of dipole antennas of different lengths are illustrated in FIG. 4.

Figure 5B:
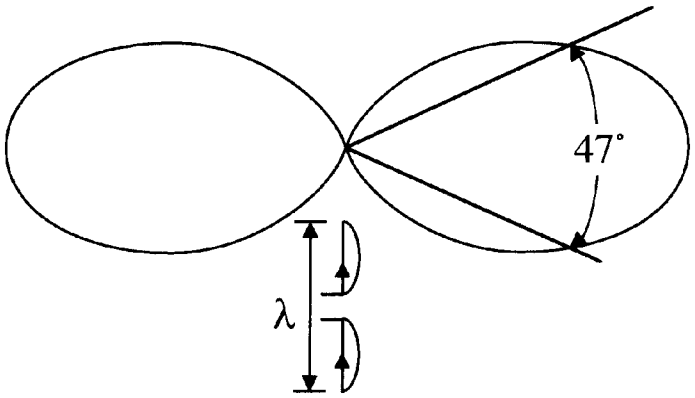
FIG. 5B illustrates the radiation pattern of a full wavelength dipole antenna.
Figure 5A:
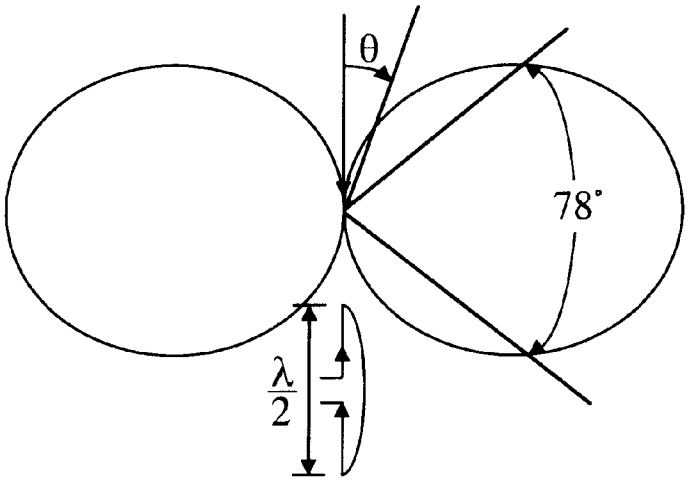
FIG. 5A illustrates the radiation patterns of a half wavelength dipole antenna.

Dipole antenna 300 exhibits a symmetric radiation pattern. A symmetric radiation pattern provides uniform gain in 360 degrees, thereby allowing equally effective communication in all directions. FIGS. 5A and 5B illustrate the radiation pattern of dipole antenna 300 having selected lengths. The current distribution in dipole antenna 300 is assumed to be sinusoidal.

FIG. 5A illustrates the radiation pattern of a dipole antenna having a length $L=\lambda/2$. The radiation pattern for $L=\lambda/2$ is given by the following equation.

$$E = \frac{\cos[(\pi/2)\cos\theta]}{\sin\theta}$$

FIG. 5B illustrates the radiation pattern of a dipole antenna having a length $L=\lambda$. The radiation pattern for $L=\lambda$ is given by the following equation.

$$E = \frac{\cos(\pi\cos\theta) + 1}{\sin\theta}$$

II. The Invention

Figure 6A:
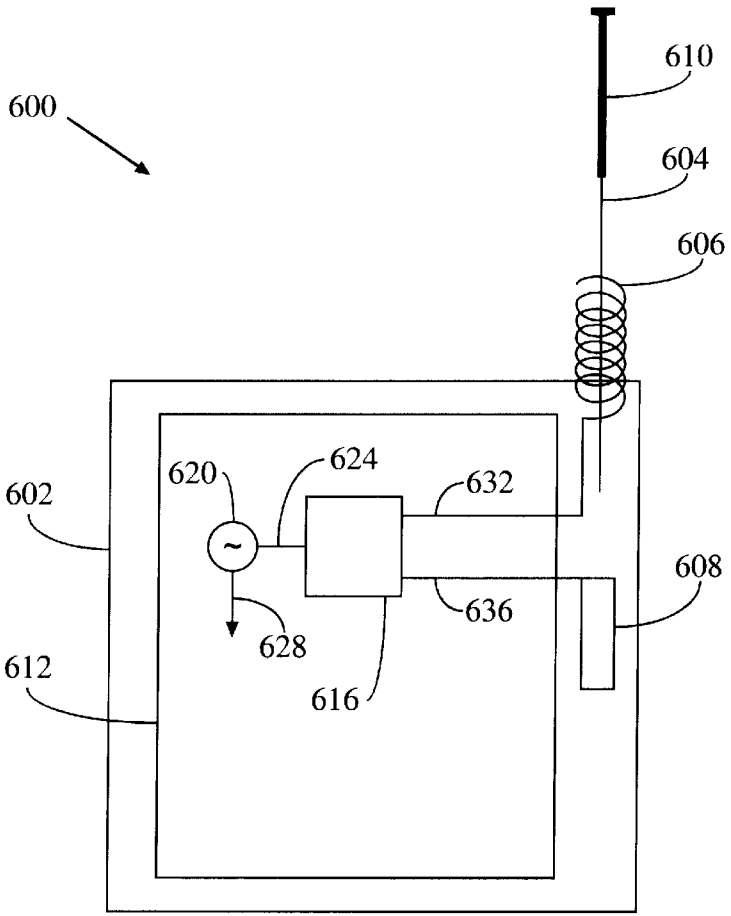
FIGS. 6A and 6B illustrate a balanced, retractable dipole antenna according to one embodiment of the present invention.
Figure 6B:
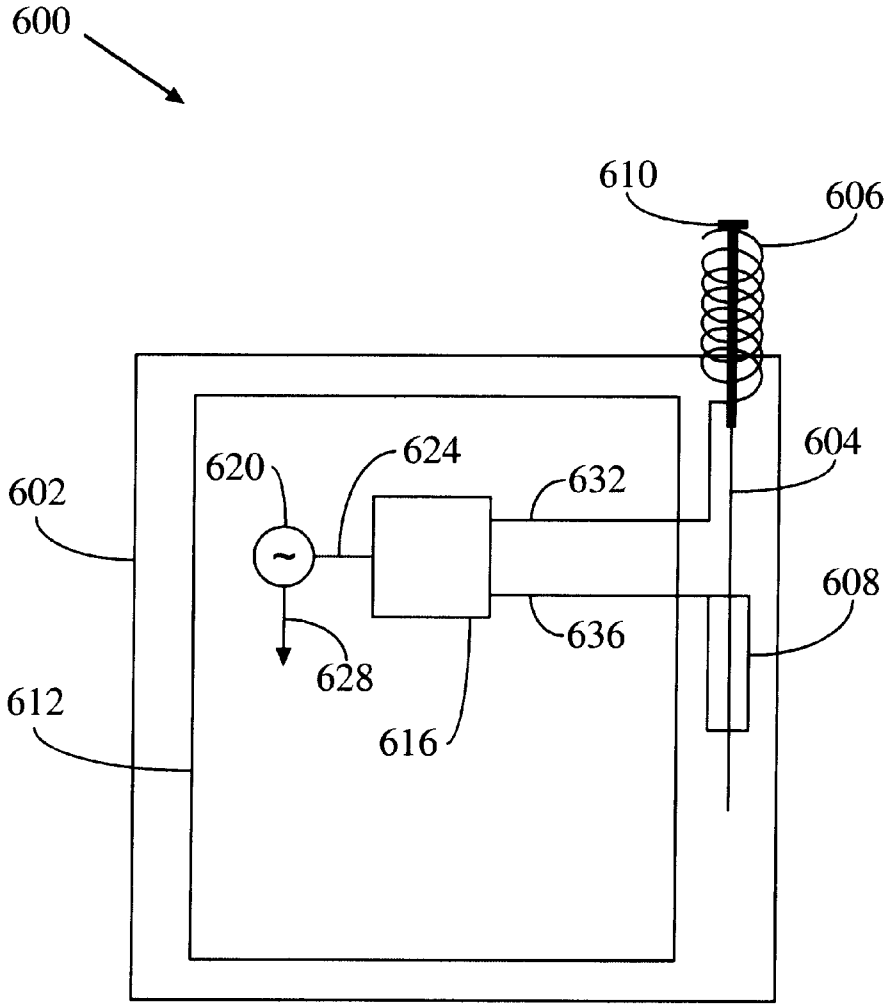

FIGS. 6A, 6B, 7A, 7B, 8A, and 8B illustrate three embodiments of the present invention. Each of these embodiments is a balanced, retractable dipole antenna. FIGS. 6A and 6B illustrate a first antenna 600 according to one embodiment of the present invention. First antenna 600 comprises a first radiator 604, a second radiator 606, a counterpoise 608, a PWB 612, and a balun 616. First antenna 600 can exist in both an extended state and a retracted state. In the extended state, first radiator 604 extends out of a casing 602. In the retracted state, first radiator 604 is retracted into casing 602. In a preferred embodiment, extension and retraction of first radiator 604 is accomplished by a user sliding it along guides provided by casing 602. However, extension and retraction of first radiator 604 may be accomplished through other techniques known to persons skilled in the relevant arts. FIG. 6A illustrates antenna 600 in its extended state. FIG. 6B illustrates antenna 600 in its retracted state.

A signal source 620 is connected to balun 616. Signal source 620 has first and second terminals 624 and 628, respectively. First terminal 624 is connected to balun 616, whereas second terminal 628 is grounded. In one embodiment, signal source 620 is mounted on PWB 612. In operation, signal source 620 provides a single ended RF signal to balun 616 by first terminal 624.

In addition to signal source 620, PWB 612 supports on board circuitry, such as, a receiver, a transmitter, and other signal processing circuitry needed for a mobile phone's operation. PWB 612 has a ground plane that provides a ground for all on board circuitry.

In general, the purpose of a balun is to connect a balanced antenna to an unbalanced source (or an unbalanced transmission line). In this embodiment, balun 616 links first radiator 604, second radiator 606, and counterpoise 608 to an unbalanced source, that is, signal source 620. Since the output of signal source 620 is single ended, it is unbalanced. If the single ended output from signal source 620 is directly coupled to first radiator 604, second radiator 606, and counterpoise 608, it would result in unbalanced currents in first antenna 600. Thus, balun 616 is used to convert an unbalanced source to a balanced source.

Balun 616 has first and second output terminals 632 and 636, respectively. First and second output terminals 632 and 636 are connected to second radiator 606 and counterpoise 608, respectively. Balun 616 converts the single ended signal to first and second signals that are carried on first output terminal 632 and second output terminal 636, respectively. First and second signals have equal magnitudes, but are out of phase by 180 degrees. The operation of balun 616 is described in detail later.

In order for first antenna 600 to operate satisfactorily, counterpoise 608 must be electrically isolated from the ground plane of PWB 612. Isolation of counterpoise 608 ensures that current will not flow from counterpoise 608 to the ground plane of PWB 612. If counterpoise 608 is not electrically isolated from this ground plane, unbalanced currents will flow along the ground plane of PWB 612, thereby resulting in a distorted radiation pattern. Isolation for counterpoise 608 can be provided by maintaining a gap between PWB 612 and counterpoise 608. For example, counterpoise 608 can be placed parallel to PWB 612 as shown in FIGS. 6A and 6B. Alternatively, counterpoise 608 can be constructed on PWB 612 by various known techniques described later. In that case, counterpoise 608 is generally separated from the ground plane of PWB by a dielectric material.

According to the present invention, radiators linked to first output terminal 632 are excited by a first signal. In addition, counterpoise 608, and any radiators connected to it, are excited by a second signal carried on second output terminal 636 that has equal magnitude, but which is out of phase with the first signal by 180 degrees. These connections result in balanced currents circulating in the radiators carrying the first signal and the counterpoise (and any connected radiators) carrying the second signal. As a result, first antenna 600 produces a symmetric radiation pattern.

Counterpoise 608 will generally be enclosed inside the mobile phone's casing 602. In other words, counterpoise 608 will not be visible from the outside. In one embodiment, first radiator 604 and counterpoise 608 have substantially similar dimensions and/or shapes. However, first radiator 604 and counterpoise 608 may have dissimilar shapes and/or dimensions. Counterpoise 608 may be printed on PWB 612. Alternatively, counterpoise 608 may be a metallic strip or a conducting wire embedded in a mobile phone's case. Counterpoise 608 may be constructed using other techniques known in the art.

In the embodiment shown in FIGS. 6A and 6B, first radiator 604 is a straight conductor. Such straight conductors are generally known as whips. A non-conducting tip 610 that is made of a non-conducting material is affixed to the top end of first radiator 604. In a preferred embodiment, non-conducting tip 610 is made out of plastic and is non-radiating. However, in alternate embodiments, non-conducting tip 610 may be made out of any non-conducting material known to persons skilled in the relevant arts. In a preferred embodiment, non-conducting tip 610 includes a nub at its end. This nub enables a user to extend first radiator 604 when it is retracted.

Second radiator 606 is a helical conductor. Second radiator 606 is physically connected to first output terminal 632 and protrudes out of casing 602. Helical radiators are well known to persons skilled in the relevant arts.

FIG. 6A illustrates first antenna 600 in its extended state. In this state, first radiator 604 extends outward from casing 602, through the center of the helix of second radiator 606, and beyond. In this position, first radiator 604 radiates the signal carried on first output terminal 632. In a preferred embodiment, the signal carried on first output terminal 632 is transferred to first radiator 604 via second radiator 606. This transfer does not require first radiator 604 to be connected to either first output terminal 632 or second radiator 606. Instead, first radiator 604 is electromagnetically excited by second radiator 606. However, in alternate embodiments, first radiator 604 can be physically connected to second radiator 606 and/or first output terminal 632 when first antenna 600 is in its extended state. When extended, first radiator 604 dominates over second radiator 606 in radiating RF energy.

FIG. 6B illustrates first antenna 600 in its retracted state. Here, first radiator 604 is retracted into casing 602. First radiator 604 no longer radiates the signal carried on first output terminal 632. Rather, first radiator 604 is physically connected to counterpoise 608. Thus, first radiator 604 acts as a counterpoise when first antenna 600 is in its retracted state. When retracted, first radiator 604 does not pass through any part of the helix of second radiator 606. Therefore, second radiator 606 does not electromagnetically excite first radiator 604. When first antenna 600 is in its retracted state, non-conducting tip 610 is located in the center of the helix of second radiator 606 with its nub protruding out of the top portion of second radiator 606. This protrusion enables a user to pull on first radiator 604 and place first antenna 600 into its extended state.

Figure 7A:
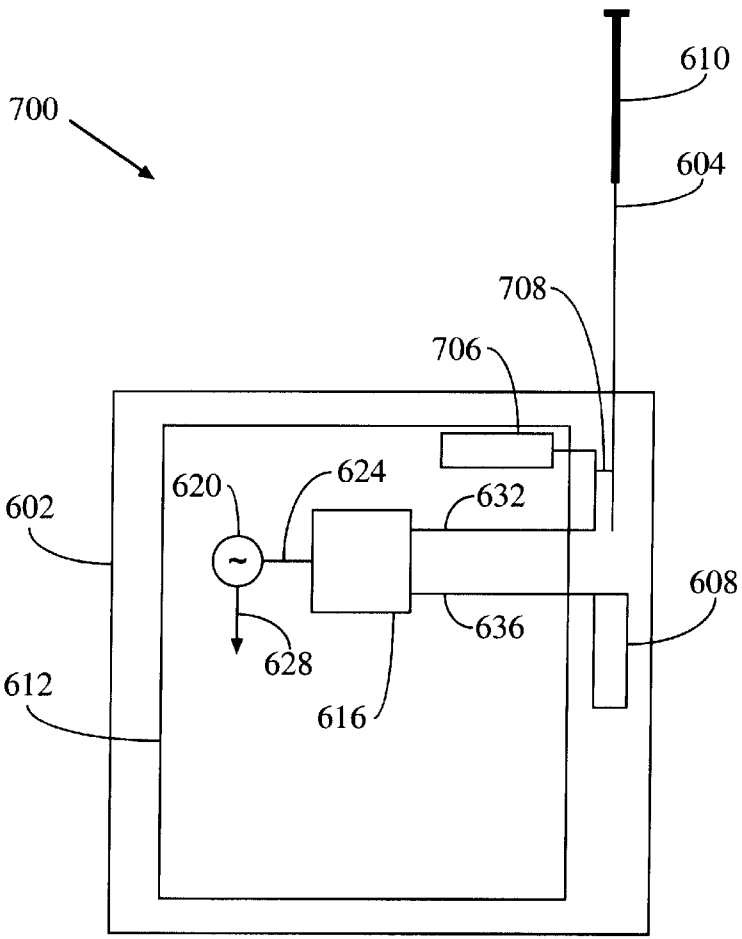
FIGS. 7A and 7B illustrate a balanced, retractable dipole antenna according to a further embodiment of the present invention.
Figure 7B:
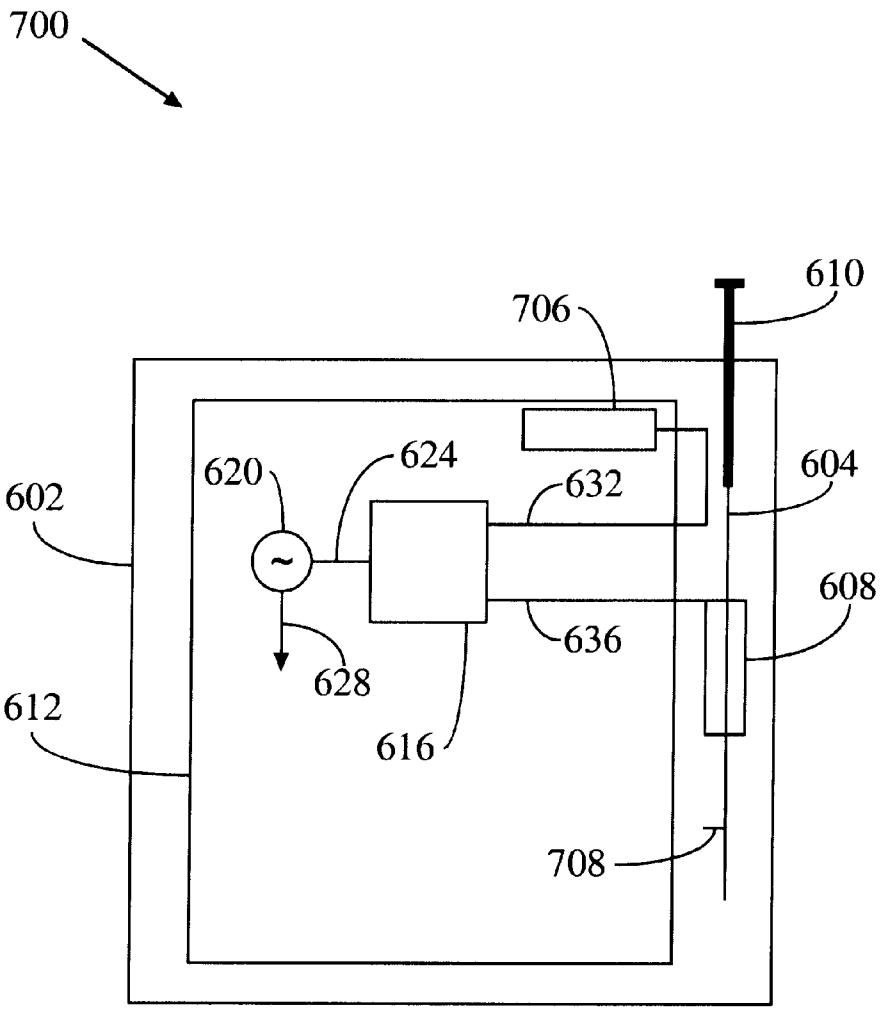

FIGS. 7A and 7B illustrate a second antenna 700 according to a further embodiment of the present invention. This embodiment contains the same components connected in the same manner as in first antenna 600, except that second radiator 606 is replaced with a substrate radiator 706. Also, a conductive clip 708 is attached to first radiator 604. Substrate radiator 706 is a conductor etched on a printed circuit board. Substrate radiator 706 is connected to first output terminal 632. In a preferred embodiment, substrate radiator 706 is etched on PWB 612. However, in alternate embodiments, substrate radiator 706 can be etched on a separate circuit board. Like first antenna 600, second antenna 700 can exist in both an extended state and a retracted state.

FIG. 7A illustrates second antenna 700 in its extended state. Here, first radiator 604 extends outward from casing 602 and is electrically connected to first output terminal 632. In a preferred embodiment, this connection is provided by clip 708. Clip 708 is attached to first radiator 604 and establishes physical contact with first output terminal 632 when first radiator 604 is extended. In alternate embodiments of second antenna 700, first radiator 604 is not physically connected to either first output terminal 632 or substrate radiator 706 when extended. Rather, in these embodiments, first radiator 604 is electromagnetically excited by substrate radiator 706 when extended.

FIG. 7B illustrates second antenna 700 in its retracted state. Here, first radiator 604 is retracted into casing 602. When retracted, clip 708 no longer contacts first output terminal 632. Thus, first radiator 604 no longer radiates the signal carried on first output terminal 632. Rather, in its retracted state, first radiator 604 is physically connected to counterpoise 608. Thus, first radiator 604 acts as a counterpoise when second antenna 700 is in its retracted state. In addition, when second antenna 700 is in its retracted state, first radiator 604 is not electromagnetically excited by substrate radiator 706.

Figure 8A:
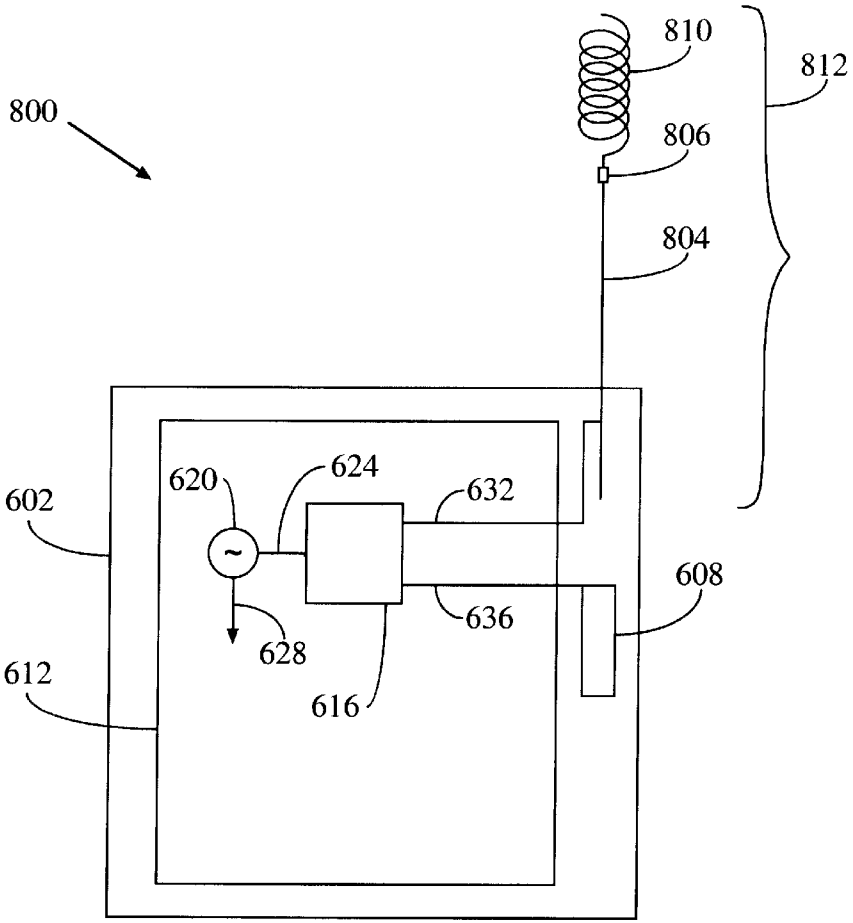
FIGS. 8A and 8B illustrate a balanced, retractable dipole antenna according to yet a further embodiment of the present invention.
Figure 8B:
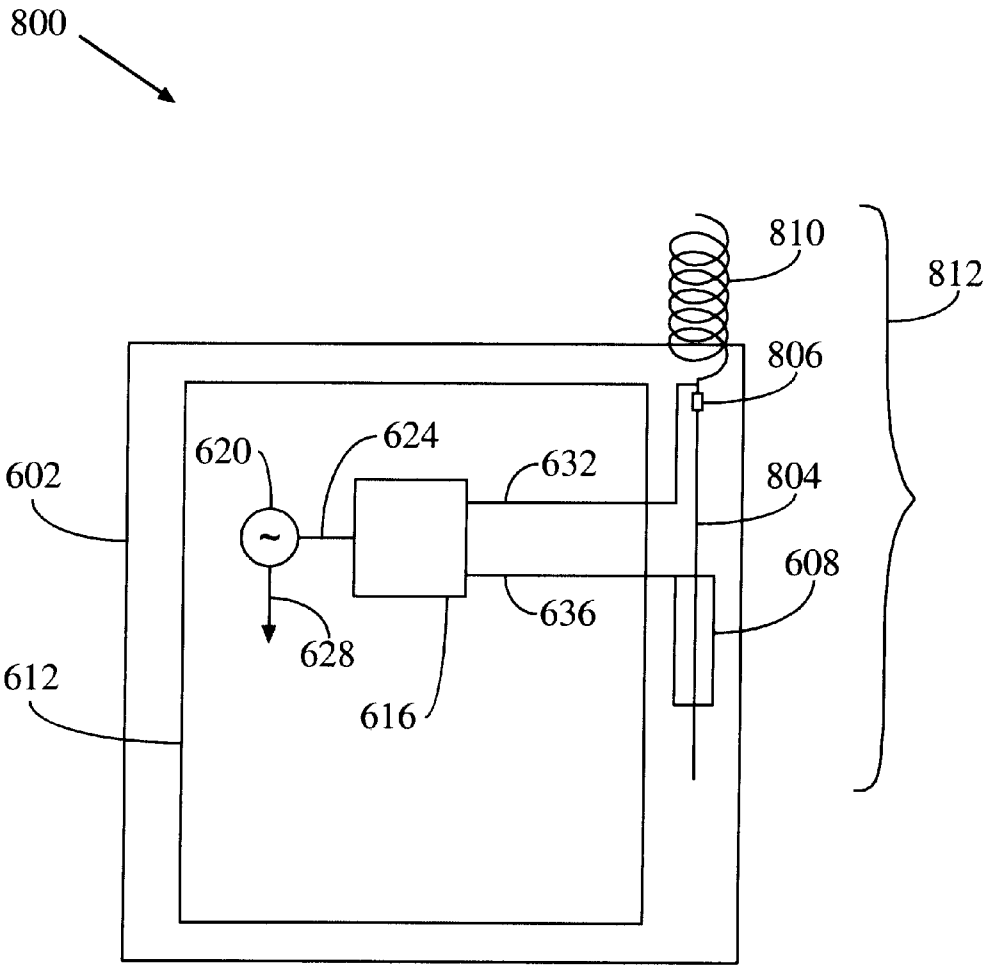

FIGS. 8A and 8B illustrate a third antenna 800 according to another embodiment of the present invention. This embodiment contains the same components as in first antenna 600, except that first radiator 604 and second radiator 606 are absent from this embodiment. Instead, third antenna 800 includes a composite radiator 812. Composite radiator 812 comprises a first radiating element 804, a connecting element 806, and a second radiating element 810. Second radiating element 810 is above connecting element 806, and connecting element 806 is above first radiating element 804. In a preferred embodiment, first radiating element 804 is a whip conductor, while second radiating element 810 is a helical conductor. However, in alternate embodiments, other conductor shapes may be employed. Connecting element 806 links first radiating element 804 with second radiating element 810. Connecting element 806 contains a switch that electrically connects and disconnects first radiating element 804 and second radiating element 810 based on the position of composite radiator 812. Like first antenna 600 and second antenna 700, third antenna 800 can exist in both extended and retracted states.

Thus, composite radiator 812 can extend out of casing 602 and into casing 602. In a preferred embodiment, connecting element 806 contains a mechanical switch that closes when composite radiator 812 is extended and opens when composite radiator 812 is retracted. Such mechanical switches are known to persons skilled in the relevant arts. In alternate embodiments, connecting element 806 employs an electronic switch.

FIG. 8A illustrates third antenna 800 in its extended state. Here, composite radiator 812 extends out of casing 602. When extended, connecting element 806 electrically connects first radiating element 804 and second radiating element 810. Since these elements are connected, composite radiator 812 is a single radiating conductor connected to first output terminal 632 when extended. Counterpoise 608 is connected to second output terminal 636.

FIG. 8B illustrates third antenna 800 in its retracted state. Here, composite radiator 812 is retracted into casing 602, leaving only second radiating element 810 protruding out of casing 602. In this state, connecting element 806 electrically isolates first radiating element 804 and second radiating element 810. Therefore, in this position, only second radiating element 810 is connected to first output terminal 632. First radiating element 804 is connected to counterpoise 608. Thus, when composite radiator 812 is in its retracted state, first radiating element 804 acts as a counterpoise to second radiating element 810.

According to the present invention, each balanced, retractable dipole antenna has a total length. This total length is the sum of two components. The first component is the combined length of radiators transmitting the signal carried on first output terminal 632. The second component is the length of counterpoise 608, along with the length of any radiators, that are transmitting the signal carried on second output terminal 636. In a preferred embodiment, this total length is the same in both the extended and retracted states. For example, when first antenna 600 is in its extended state, the total length of first antenna 600 is the combined length of first radiator 604 and counterpoise 608. However, when first antenna 600 is in its retracted state, where first radiator 604 is acting as a counterpoise, the total length of antenna 600 is the combined length of second radiator 606 and first radiator 604. Both of these total lengths are substantially equal. Likewise, this principle applies for second antenna 700, third antenna 800, and other embodiments of balanced, retractable dipole antennas according to the present invention.

In a preferred embodiment, total length is $\lambda/2$, where $\lambda$ is a wavelength corresponding to an operating frequency. However, other total lengths can be used, such as, $\lambda$, $\lambda/4$, etc. In one embodiment, total length is sized to operate over a cellular frequency band (approximately 900 MHz). In another embodiment, total length is sized to operate over a PCS frequency band (approximately 1.9 GHz).

Although, the balanced, retractable dipole antennas described according to the present invention have been described for use in mobile phones, the underlying concept behind the present invention can be adapted to other communications devices. Furthermore, antennas described herein are capable of both signal transmission and signal reception.

Figure 9:
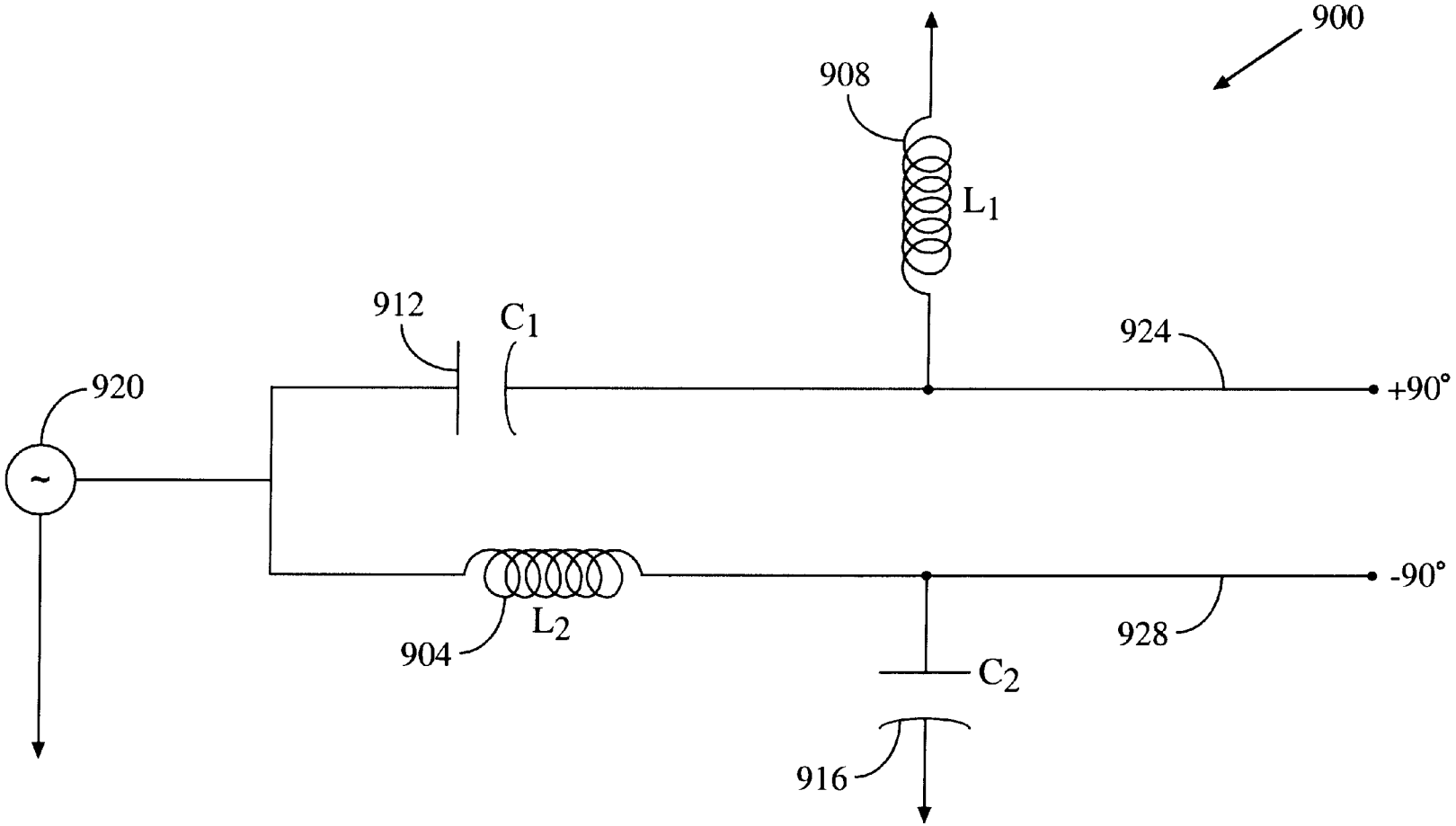
FIGS. 9, 10 and 11 illustrate baluns in accordance with three embodiments of the present invention.

FIG. 9 illustrates a balun 900 in accordance with one embodiment. Balun 900 receives a single ended, unbalanced signal from a signal source and outputs a balanced signal to a dipole antenna. Balun 900 comprises two inductors 904, 908 and two capacitors 912, 916. Inductor 904 and capacitor 912 are connected at one end to a signal source 920. Inductor 908 is connected at one end to capacitor 912 while the other end of inductor 908 is grounded. Capacitor 916 is connected at one end to inductor 904 while the other end of capacitor 916 is grounded. Output signals 924 and 928 are balanced and are phase shifted from each other by 180 degrees.

Figure 10:
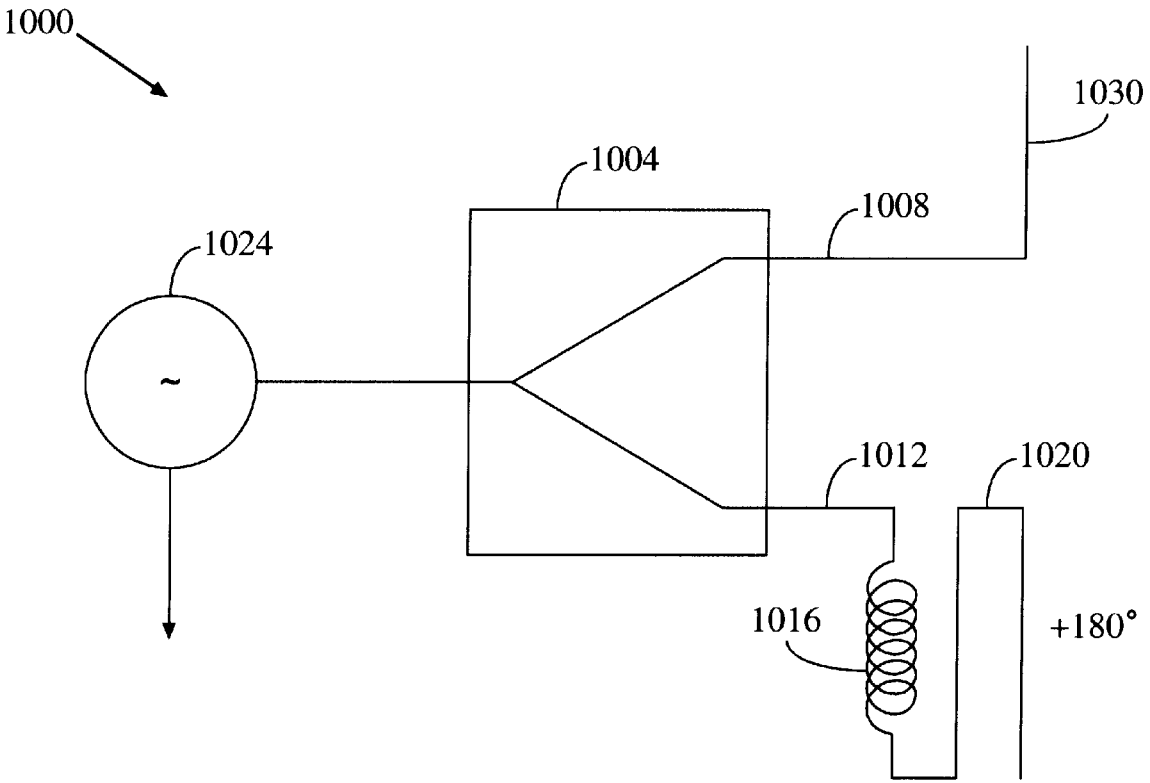

FIG. 10 illustrates a balun 1000 in accordance with another embodiment. Balun 1000 comprises a power splitter 1004 that receives a single ended output from a signal source 1024 and outputs a balanced signal at output terminals 1008 and 1012. An inductor or choke 1016 is connected in series to an output terminal 1012. Output terminal 1008 is connected to a radiator 1030, while output 1012 is connected to a counterpoise 1020 through inductor 1016.

The function of the power splitter 1004 is to split a signal from signal source 1024 into two signals each having an equal magnitude. The first signal is provided to radiator 1030. The second signal is phase shifted 180° by inductor 1016 and the phase shifted signal is then provided to counterpoise 1020. Baluns 900 and 1000 are described as illustrative examples only.

Figure 11:
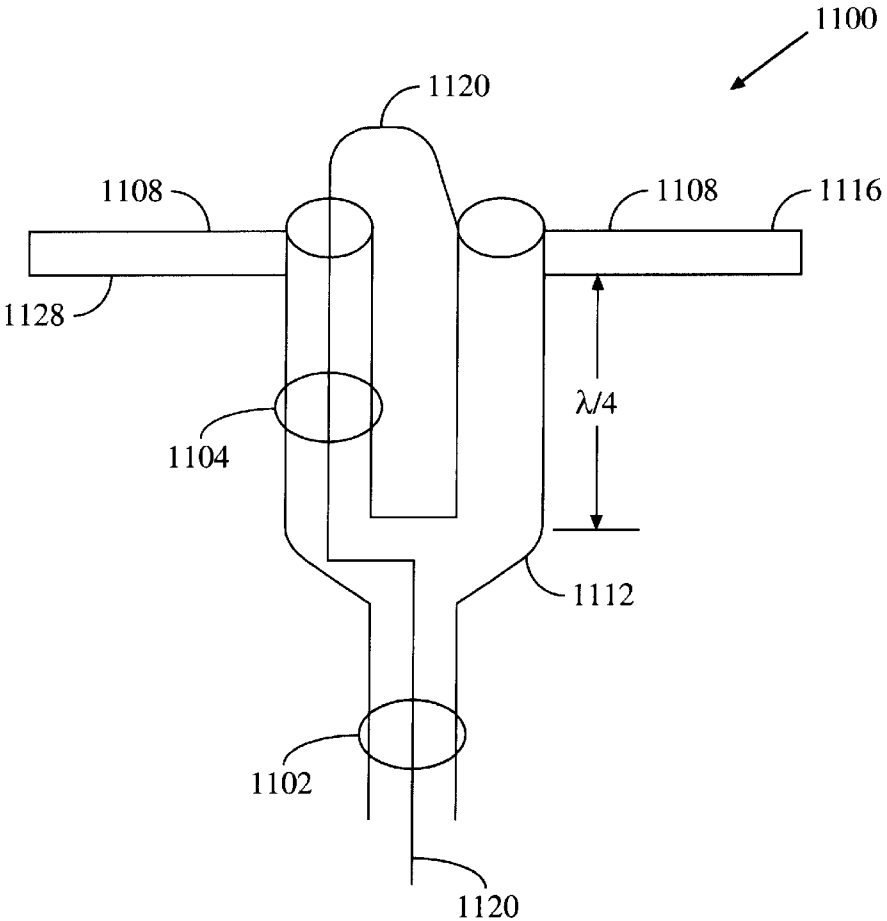

FIG. 11 illustrates a folded balun 1100 that allows direct connection of a coaxial line 1102 to a dipole antenna 1108. A coax outer conductor 1112 is connected to a pole 1116 fed from a center conductor 1120. Coax 1112 runs alongside a feeder coax 1104 for a quarter wavelength. Another pole 1128 connects directly to the shield of feeder coax 1104. While a few selected baluns have been described, it will become apparent to persons skilled in the art that other types of baluns can be easily used in the present invention.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A balanced, retractable dipole antenna for use in a mobile phone having a casing, and a signal source, transmit and receive circuits, and a printed wire board (PWB) having a ground plane formed thereon for the signal source and for the transmit and receive circuits contained in the casing, comprising:

a first radiator element formed of a conducting material and being selectively extendable from and retractable into the casing;

a second radiator element formed of a conducting material;

a counterpoise formed of a conducting material and electrically isolated from the PWB ground plane;

a signal balancing means coupled between the signal source and at least said second radiator element and counterpoise to generate first and second signals, respectively, wherein said first and second signals are substantially equal in magnitude but out of phase by 180 degrees;

means for transferring said first signal to said second radiator element;

means for transferring said second signal to said counterpoise;

means for transferring said first signal to said first radiator element when said first radiator element is extended; and means for transferring said second signal to said first radiator element when said first radiator element is retracted.

2. The balanced, retractable dipole antenna of claim 1, wherein said second radiator element is a helical conductor.

3. The balanced, retractable dipole antenna of claim 1, wherein said first radiator element is a whip conductor.

4. The balanced, retractable dipole antenna of claim 1, wherein said second radiator element is a substrate radiator.

5. The balanced, retractable dipole antenna of claim 1, wherein said means for transferring said first signal to said first radiator element comprises means for electromagnetically coupling said first radiator element to said second radiator element.

6. The balanced, retractable dipole antenna of claim 1, wherein said means for transferring said first signal to said first radiator element comprises means for electrically connecting said first radiator element to said signal balancing means.

7. The balanced, retractable dipole antenna of claim 6, wherein said means for electrically connecting said first radiator element to said signal balancing means comprises a conducting clip attached to said first radiator element.

8. The balanced, retractable dipole antenna as recited in claim 1, wherein said counterpoise is printed on the PWB.

9. The balanced, retractable dipole antenna as recited in claim 1, wherein said counterpoise is a conducting wire.

10. The balanced, retractable dipole antenna as recited in claim 1, wherein said counterpoise is a metallic strip.

11. The balanced, retractable dipole antenna as recited in claim 1, wherein said first and second signals are in cellular frequency band.

12. The balanced, retractable dipole antenna as recited in claim 1, wherein said first and second signals are in PCS frequency band.

13. The balanced, retractable dipole antenna as recited in claim 1, wherein the total length of the antenna is $\lambda$, where $\lambda$ is the wavelength corresponding to an operating frequency.

14. The balanced, retractable dipole antenna as recited in claim 1, wherein the total length of the antenna is $\lambda/2$, where $\lambda$ is the wavelength corresponding to an operating frequency.

15. The balanced, retractable dipole antenna as recited in claim 1, wherein the total length of the antenna when said first radiator element is extended is substantially equal to the total length of the antenna when said first radiator element is retracted.

16. A balanced, retractable dipole antenna for use in a mobile phone having a casing, and a signal source, transmit and receive circuits, and a printed wire board (PWB) having a ground plane formed thereon for the signal source and for the transmit and receive circuits contained in the casing, comprising:

a composite radiator element that is selectively extendable from and retractable into the casing having a first radiator element formed of a conducting material, a connecting element coupled to said first radiator element, and a second radiator element formed of a conducting material coupled to said connecting element, wherein said connecting element electrically connects said first and second radiator elements when said composite radiator is extended and electrically disconnects said first and second radiator elements when said composite radiator is retracted;

a counterpoise formed of a conducting material and electrically isolated from the PWB ground plane;

a signal balancing means coupled between the signal source and at least said second radiator element and counterpoise to generate first and second signals, respectively, that are substantially equal in magnitude but out of phase by 180 degrees;

means for transferring said first signal to said first radiator element and said second radiator element when said composite radiator element is extended; and means for transferring said first signal to said second radiator element and said second signal to said first radiator element when said composite radiator element is retracted.

17. The balanced, retractable dipole antenna of claim 16, wherein said second radiator element is a helical conductor.

18. The balanced, retractable dipole antenna of claim 16, wherein said first radiator element is a whip conductor.

19. The balanced, retractable dipole antenna as recited in claim 16, wherein said counterpoise is printed on the PWB.

20. The balanced, retractable dipole antenna as recited in claim 16, wherein said counterpoise is a conducting wire.

21. The balanced, retractable dipole antenna as recited in claim 16, wherein said counterpoise is a metallic strip.

22. The balanced, retractable dipole antenna as recited in claim 16, wherein said first and second signals are in cellular frequency band.

23. The balanced, retractable dipole antenna as recited in claim 16, wherein said first and second signals are in PCS frequency band.

24. The balanced, retractable dipole antenna as recited in claim 16, wherein the total length of the antenna is $\lambda$, where $\lambda$ is the wavelength corresponding to an operating frequency.

25. The balanced, retractable dipole antenna as recited in claim 16, wherein the total length of the antenna is $\lambda_{,}/2$, where $\lambda_{,}$ is the wavelength corresponding to an operating frequency.

26. The balanced, retractable dipole antenna as recited in claim 16, wherein the total length of the antenna when said composite radiator element is extended is substantially equal to the total length of the antenna when said composite radiator element is retracted.

* * * * *